US007308860B2

(12) United States Patent
Singh et al.

(10) Patent No.: US 7,308,860 B2
(45) Date of Patent: Dec. 18, 2007

(54) SEWING MACHINE FOR DECORATIVELY STITCHING A CRICKET BALL

(75) Inventors: Hardyal Singh, West Bengal (IN); Surinder Singh Sehmby, West Bengal (IN); Narayan Prasad Mukherjee, West Bengal (IN); Gopalsamy Balamurugan, West Bengal (IN); Uma Datta, West Bengal (IN); Joydeb Roychoudhury, West Bengal (IN)

(73) Assignee: Council of Scientific and Industrial Research, New Delhi (IN)

( * ) Notice: Subject to any disclaimer, the term of this patent is extended or adjusted under 35 U.S.C. 154(b) by 90 days.

(21) Appl. No.: 11/303,457

(22) Filed: Dec. 16, 2005

(65) Prior Publication Data

US 2006/0254485 A1 Nov. 16, 2006

Related U.S. Application Data

(63) Continuation of application No. 10/525,350, filed as application No. PCT/IB02/003400 on Aug. 23, 2002, now abandoned.

(51) Int. Cl.
*D05B 27/00* (2006.01)
*D05B 13/00* (2006.01)

(52) U.S. Cl. ..... 112/470.35

(58) Field of Classification Search ..... 112/470.35, 112/152, 153, 311, 221, 475.08; 473/FOR. 136, 473/FOR. 157, FOR. 148, FOR. 152
See application file for complete search history.

(56) References Cited

U.S. PATENT DOCUMENTS

| | | | | | |
|---|---|---|---|---|---|
| 508,315 | A * | 11/1893 | Howell | 112/475.11 |
| 1,167,265 | A * | 1/1916 | Brusseau | 112/470.35 |
| 3,151,584 | A * | 10/1964 | Fossa | 112/470.35 |
| 4,203,941 | A * | 5/1980 | Brooker | 264/250 |
| 4,248,165 | A * | 2/1981 | Addy et al. | 112/470.35 |
| 4,327,655 | A | 5/1982 | Andy et al. | |
| 4,665,844 | A * | 5/1987 | Shibata | 112/103 |
| 6,019,053 | A | 2/2000 | Kawaguchi | |
| 7,048,656 | B2 * | 5/2006 | Litchfield | 473/598 |

FOREIGN PATENT DOCUMENTS

| | | | |
|---|---|---|---|
| GB | 385436 | | 12/1932 |
| GB | 2097262 | A * | 11/1982 |
| GB | 2097320 | | 11/1982 |
| GB | 2183489 | A * | 6/1987 |
| GB | 2421192 | A * | 6/2006 |

* cited by examiner

*Primary Examiner*—Ismael Izaguirre
(74) *Attorney, Agent, or Firm*—Ladas & Parry

(57) ABSTRACT

The present invention relates to a novel sewing machine for decoratively stitching a cricket ball, the machine of the present invention will be particularly useful to provide decorative stitching on hemispherical leather cups prior to assembling them and stitching them to form the cricket ball.

21 Claims, 5 Drawing Sheets

FIGURE 2
Figure 2 (A)
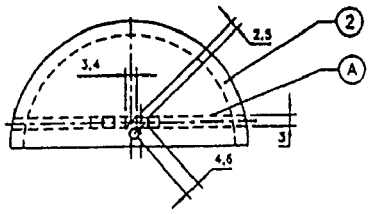
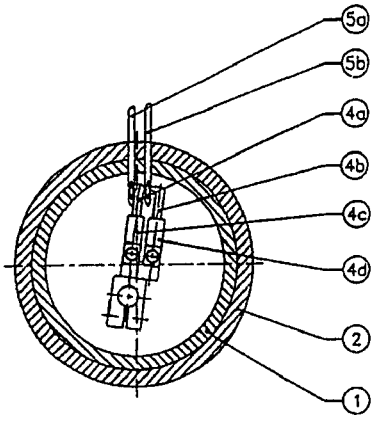
Figure 2 (B)
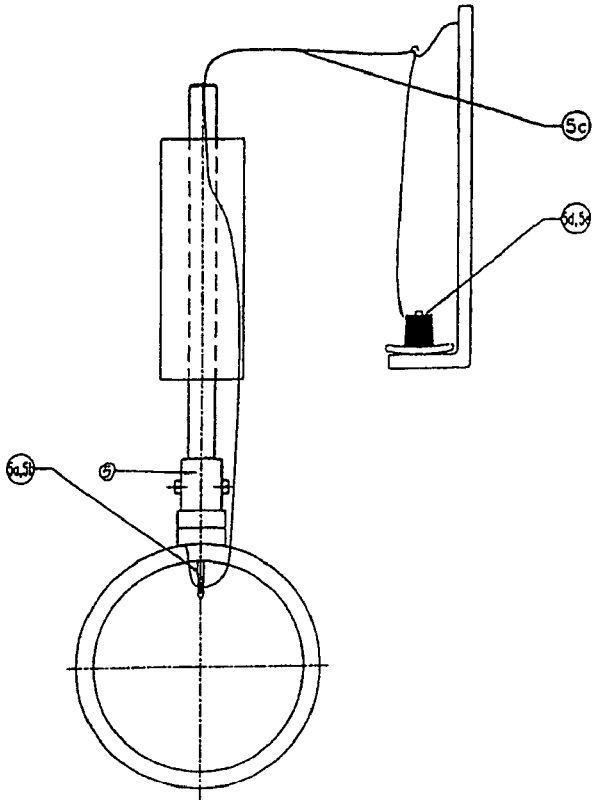
Figure 2 (C)

SEWING MACHINE FOR DECORATIVELY STITCHING A CRICKET BALL

This application is a continuation of application Ser. No. 10/525,350 filed on Feb. 23, 2005, now abandoned which is A 371 of International Application PCT/IB2002/003400 filed on Aug. 23, 2002, which designated the U.S., claims the benefit thereof and incorporates the same by reference.

TECHNICAL FIELD

The present invention relates to a novel sewing machine for decoratively stitching a cricket ball. The machine of the present invention will be particularly useful to provide decorative stitching on hemispherical leather cups prior to assembling them and stitching them to form the cricket ball.

BACKGROUND ART

The prior art search covering literature, patents and industrial survey reveals the following technologies for manufacture of cricket balls, specifically the step of decorative stitching. In FIG. 1 of the drawing accompanying this specification, a schematic drawing of a cricket ball is given showing the decorative stitching. In the drawings (A) denotes decorative stitching and (B) denotes seam stitching.

The cricket balls are generally manufactured completely by manual process. For providing decorative stitching the two hemispherical cups are prepunched circumferentially in two rows and they are stitched with curved needle which passes at about an angle of 15° through prepunched holes. This manual operation usually takes stitching time of around 1 hr for one hemispherical cup. As the quality of stitching mainly depends upon the skill of the operator, it is very difficult to get consistent quality stitching and it varies from individual to individual.

It may be noted there are international standards specify the spacing between the rows of stitches and also total number of stitches on the circumference for each row. It is, however, not possible to obtain the stitches with the help of any existing standard machine. Reference may be made to patent no. GB 2097320 dated Mar. 11, 1982 which comprises of placing two cover forming pieces in a spherical cavity of a mould. A suitable core forming material such as polyurethane is injected into the space between the said pieces so as to form, after setting a core for the ball which also connects the two pieces together. Each of said pieces may be provided around its periphery with one or more rows of stitching which project outwardly so as together to form a seam for the completed ball. This method does not describe the decorative stitching and it is useful only for joining two hemispherical cups. Decorative stitching specialty on cricket ball surface is guided by International Standards. In order to maintain the specified standard, it is essential to have a two needle sewing system. The existing two needle system cannot be used to provide the specified decorative stitching on cricket balls for the following reasons:

a) Distance between needles of existing two needle system is much more than what is required for decorative stitching.

b) Two needles cannot be held closely apart with the existing two needle holding system.

c) Proper needle looper interaction is not possible within the extremely narrow space of the order of less than 1 mm between the two needles with the existing two needle system.

To the best of the Applicant's knowledge, there is no machine existing anywhere in the world for providing a finished cricket ball in general and for providing decorative stitching in particular.

OBJECTS OF THE INVENTION

The main object of the present invention is to provide a novel sewing machine for decorative stitching useful in the manufacture of cricket balls which obviates the drawbacks associated with the manual process.

Another object of the present invention is to provide low cost automation for a small scale industry so that productivity increases and production cost of cricket balls is reduced.

Yet another object of the present invention is to provide uniform quality of stitching of cricket balls and reduce the rejections, thereby increasing productivity.

BRIEF DESCRIPTION OF THE ACCOMPANYING DRAWINGS

In the drawings accompanying the specification,

FIG. 2 (A, B and C) represent the schematic drawing of the novel dual needle looper assembly.

SUMMARY OF THE PRESENT INVENTION

Figure 1:
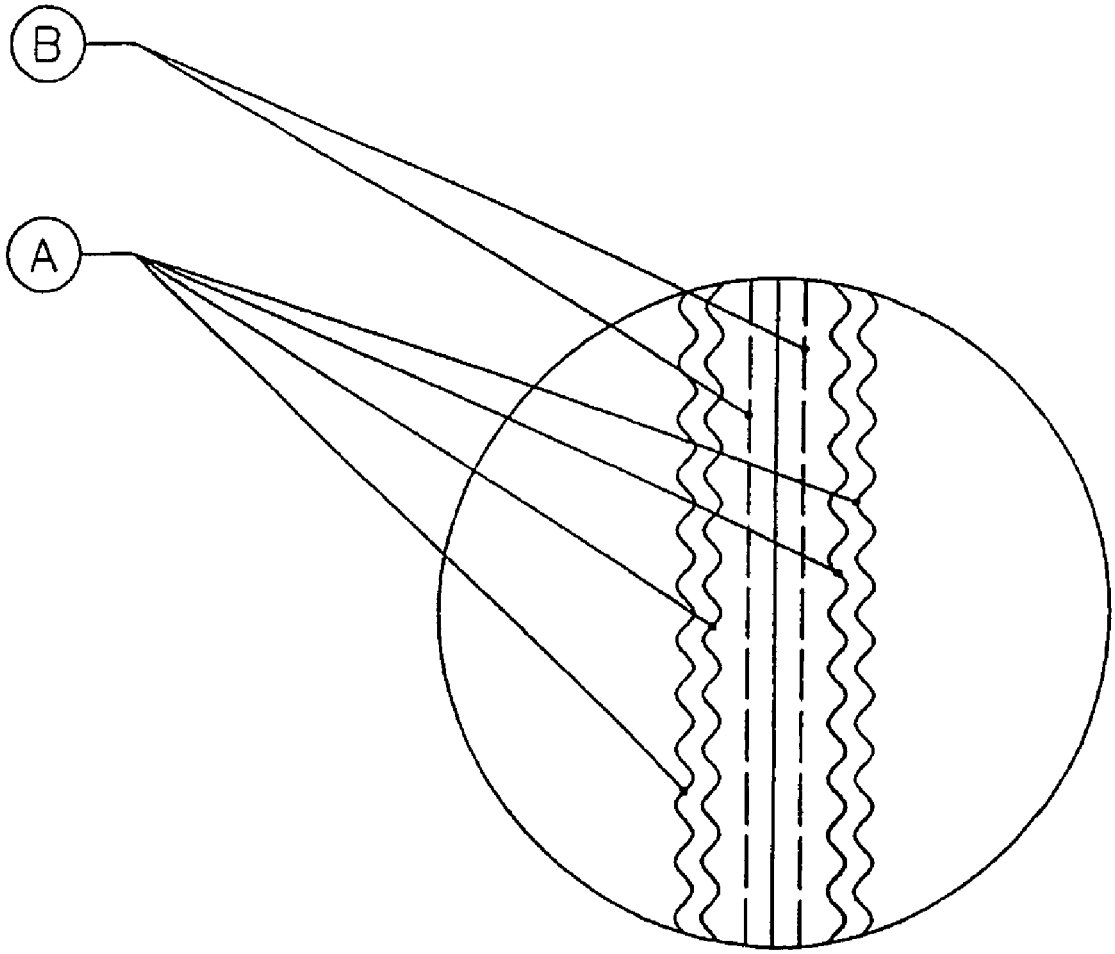
FIG. 1 represents the conventional cricket ball with the seam stitching (A) and the decorative stitching (B).

The present invention relates to a novel sewing machine for decoratively stitching a cricket ball. The machine of the present invention will be particularly useful to provide decorative stitching on hemispherical leather cups prior to assembling them and stitching them to form the cricket ball.

DETAILED DESCRIPTION OF THE PRESENT INVENTION

Accordingly, the present invention provides a novel sewing machine for decoratively stitching a cricket ball, said sewing machine comprising:

a dual needle looper assembly comprising of plurality of needles [(5*a*) and (5*b*)] placed parallel to each other in an offset manner and being fixed onto a needle holder (5), said plurality of needles having corresponding loopers [(4*a*) and (4*b*)] placed below the needles, said loopers being mounted on looper holders [(4*c*) and (4*d*)];

said dual needle looper assembly being mounted on a reciprocating means;

said dual needle looper assembly being encased within a hemispherical hollow mandrel assembly (1) having an opening/pores to allow reciprocating movement of the needles;

said hemispherical hollow mandrel assembly being mounted with a hemispherical leather cup (2) on which decorative stitching is to be performed;

said hemispherical hollow mandrel mounted with the leather cup being freely mounted on a ball bearing support (3) and being in contact with a ball holder (13), and said ball holder is mounted on an indexer assembly to provide circular indexing movement to the hemispherical leather cup.

In an embodiment of the present invention, the needles (5*a*) and (5*b*) are placed at a parallel distance as desired by the user or as prescribed by the international standards.

In another embodiment of the present invention, the needles (5*a*) and (5*b*) are placed at a parallel distance of the order of 3 mm from each other.

In yet another embodiment of the present invention, the needles (5*a*) and (5*b*) are offset circumferentially by a distance of the order of 4.6 mm from each other.

In still another embodiment of the present invention, loopers (4*a*) and (4*b*) mounted on looper holders (4*c*) and (4*d*) make coordinated oscillating movement with respect to reciprocating movement of the corresponding needles.

In one more embodiment of the present invention, said reciprocating means comprises of:

a gear box (6) capable of providing reciprocating motion to the plurality of needles and corresponding oscillating motion to respective loopers, said gear box comprising a pair of timer pulleys (7) capable of varying the speed of stitching;

said timer pulley (7) being configured to receive rotational motion from a V-belt pulley (10) through a Timer belt (8), and said V-belt pulley (10) configured to receive rotational motional from a clutch motor (9) through a V-belt (11).

In one another embodiment of the present invention, the needles are supplied with stitching threads (5*c*) from a plurality of bobbins (5*d* and 5*e*).

In a further embodiment of the present invention, the opening/pores in the hemispherical hollow mandrel assembly (1) is located on top of the needles such that the needles reciprocate through the opening/pores.

In an embodiment of the present invention, the hemispherical hollow mandrel assembly is mounted with the hemispherical leather cup (2) such that the needles are perpendicular to the surface of the hemispherical leather cup.

In another embodiment of the present invention, the ball holder (13) is in the form of a hemispherical cup.

In still another embodiment of the present invention, additional means for clamping the leather cup is optionally provided.

In yet another embodiment of the present invention, the indexing movement to the leather cup is provided in coordination with the reciprocating needle movement.

In one more embodiment of the present invention, the indexer assembly comprises of:

a stepper motor (17) being coupled to a worm wheel (20) through a worm shaft (19);

said worn shaft being coupled to the ball holder (13) for providing indexing movement to the leather cup;

a pinion handle (15) mounted on the indexer assembly for moving the indexer assembly (12) towards the hemispherical mandrel (1) and a locking handle (16) mounted on the indexer assembly for locking the position of the indexer assembly with respect to the hemispherical mandrel, and an encoder (14) configured to control the motion of the stepper motor with respect to the reciprocating movement of the needles.

In one another embodiment of the present invention, the indexer assembly further comprises a top cover (21), an indexer housing (22) and a front end cover (24) for housing the indexer and an encoder housing (23) mounted at a rear end of the indexer assembly for housing the encoder.

In a further embodiment of the present invention, the dual needle looper assembly is mounted with an optical sensor (25) for sensing the location of the needles with respect to the leather cup and counting the number of stitches made on the leather cup.

In an embodiment of the present invention, the output of the optical sensor (25) is provided as an input to the encoder.

In another embodiment of the present invention, the output of the encoder controls the circular indexing movement of the hemispherical hollow mandrel.

In still another embodiment of the present invention, the encoder is an adjustable/programmable encoder such as to obtain uniform spacing between two adjacent stitches.

In yet another embodiment of the present invention, the output of the encoder is preset to provide accurate circular indexing movement to the hemispherical hollow mandrel that are in coordination with the reciprocating movements of the needles.

In one more embodiment of the present invention, the encoder is adjusted to make 65 stitches in a single row over the circumference.

In one another embodiment of the present invention, the device takes 5 to 10 minutes to complete two rows of decorative stitching on a hemispherical leather cup.

DETAILED DESCRIPTION OF THE PREFERRED EMBODIMENTS

In the drawings accompanying this specification, FIGS. 2A, 2B and 2C show the schematic drawing of the novel dual needle looper assembly consisting of needles (5*a*, 5*b*), needle holder (S), loopers (4*a*, 4*b*) and looper holders (4*c*, 4*d*). The loopers (4*a*, 4*b*) and needles (5*a*, 5*b*) are suitably mounted to ensure proper interaction between each other during stitching. More particularly, the needles (5*a*, 5*b*) are closely spaced at a parallel distance of about 3 mm but offset circumferentially to enable the loopers (4*a*, 4*b*) fixed to looper holders (4*c*, 4*d*) to make coordinated oscillating movements with respect to the reciprocating movements of the needles of diameter 2 mm. Two bobbins (5*d* and 5*e*) are fixed on the stitching head to supply thread (5*c*) required for the stitching operation.

Figure 3:
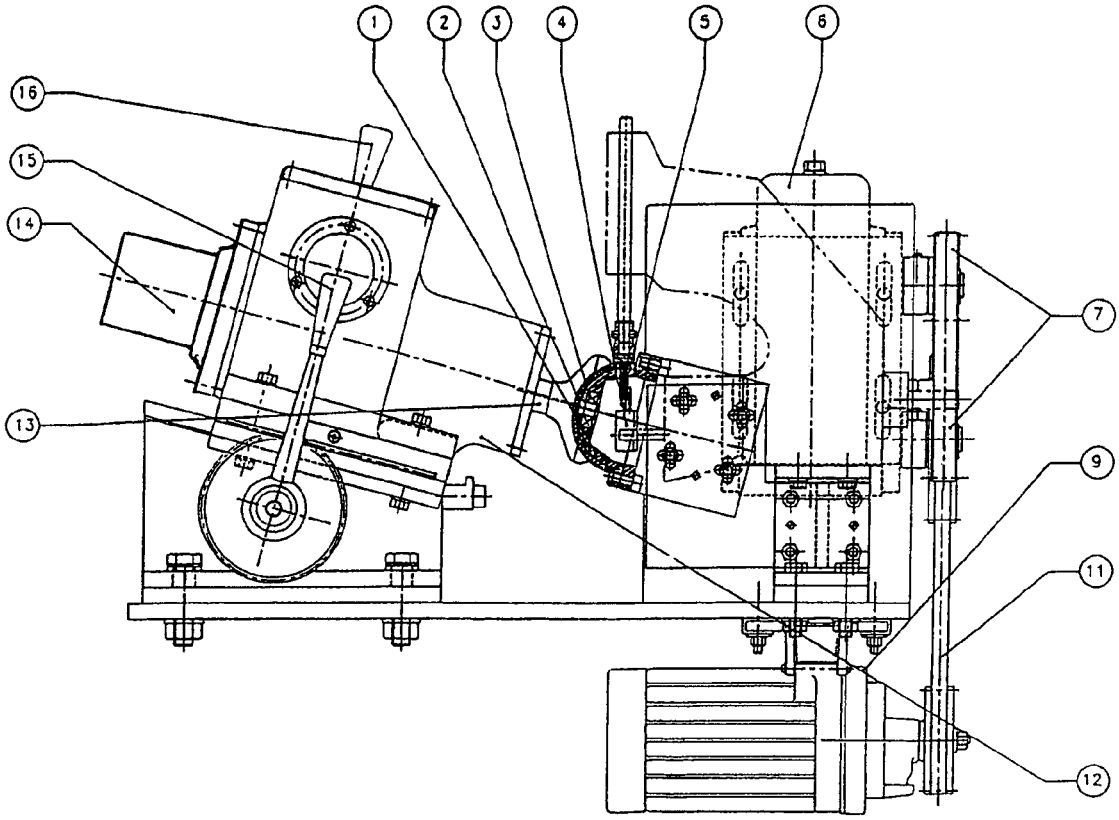
FIG. 3 represent the schematic view of the sewing machine of the present invention for providing decorative stitching.
Figure 4:
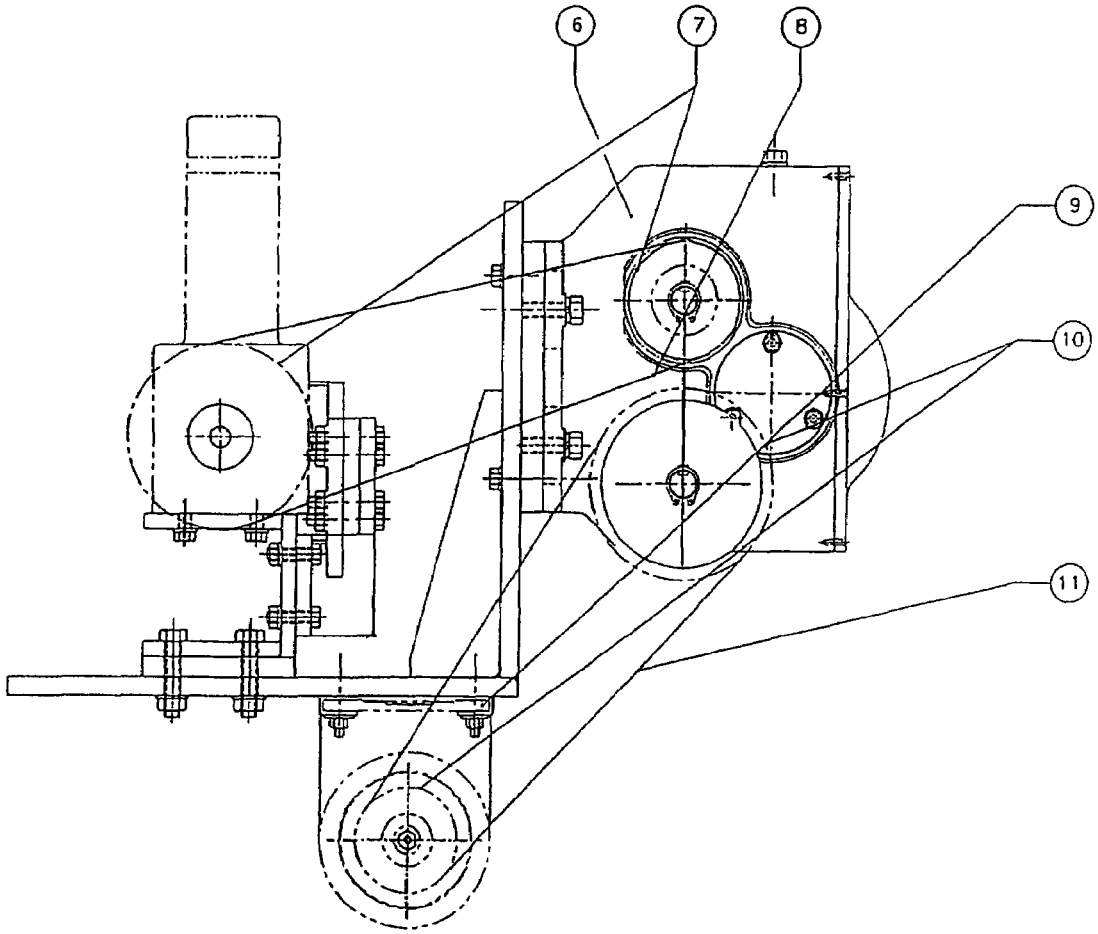
FIG. 4 represents the schematic drawing of the reciprocating means.

FIG. 3 shows the stitching head which has been used for chain stitching using the dual needles and dual loopers as detailed in FIG. 2. A hemispherical mandrel (1) is attached to the machine in such a way that it holds the hemispherical leather segment (2) firmly against the hemispherical cup fixed to the indexer shaft. The hemispherical mandrel (1) is freely mounted on a ball bearing support (3) which helps the indexing movements of the leather segment. The gear box (6) is suitably designed along with a pair of timer pulleys (7) to provide suitable speed to the needles. The clutch motor (9) drives the gear box through V belt (11) (also see FIG. 4).

Figure 5:
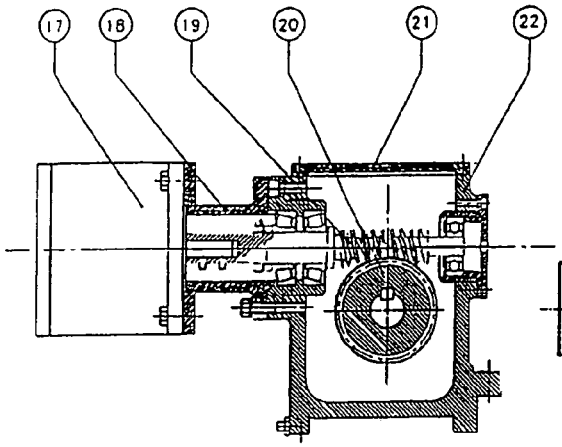
FIG. 5 (A and B) represents the schematic drawing of the indexing means.
Figure 5:
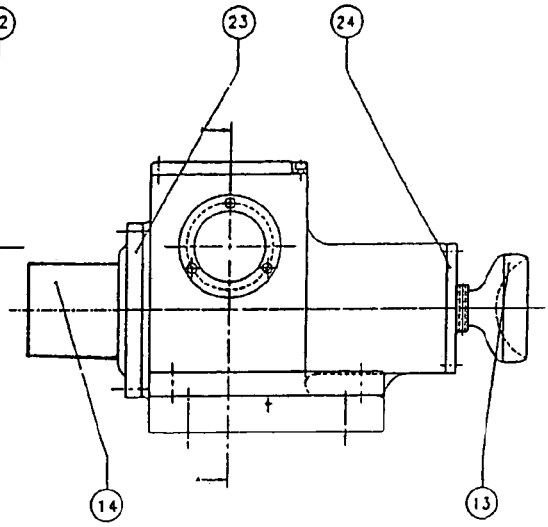

The indexer assembly (see FIG. 5) consisting of a worm (19) and worm wheel (20) is used to hold and provide indexing motions to the hemispherical leather segment (2) with respect to the reciprocating needle movements. A stepper motor (17) has been used to drive the indexer shaft. Locking mechanism (16) is provided for locking the indexer assembly (12) while stitching. An electronic control unit is provided to maintain a fixed number of stitches over the circumference of the leather segment. An encoder (14) mounted on the rear end of the indexer shaft is used to obtain accurate indexing and thereby uniformity in the spacing of the chain stitches. An optical sensor fixed on the upper part of the body of the stitching machine is used to sense the position of the needle with respect to the leather segment. As soon as the needle moves out of the leather segment, stepper motor (17) starts the indexing movement and the controller starts counting the pulses received from the encoder (14). As soon as the required count of stitches on the periphery is reached, stepper motor (17) stops automatically. The accuracy of indexing depends on the accuracy of the encoder (14).]

The sequence operations of the novel machine is as follows:

Initially the machine should be set such that the following-conditions are ensured:

(a) The loopers are in proper orientation with the needles.

(b) The threads have proper tensions.

(c) The clutch motor is in disengaged condition.

The hemispherical leather segment (2) is placed over the hemispherical mandrel (1) attached to the stitching machine such that the axis of the hemispherical mandrel (1) and hemispherical leather segment (2) are properly aligned. The indexer assembly (12) is moved towards the hemispherical mandrel (1) by manually operating the pinion handle (15). Some amount of pressure is applied to the hemispherical leather segment (2) by means of pinion handle (15). The indexer assembly (12) is locked in this position by means of locking handle (16). Additional clamping pressure if required can be applied by special holding arrangement.

The clutch motor (9) is initially in disengaged condition and the initial position of the needles (5*a* and 5*b*) is above the leather segment (2). As the machine is switched ON, the clutch motor (9) will be ON and the clutch will move into engagement with the motor. The rotation of the motor produces reciprocating movement of the needles (5*a* and 5*b*) through V belt (11), gear box (6), Timer belt (8) and linkage mechanism built into the machine. Simultaneously, the motion is also transferred to the Looper shaft which produces oscillating movements of the loopers (4*a* and 4*b*). Proper interaction between needles (5*a* and 5*b*) and loopers (4*a* and 4*b*) is necessary for proper stitching. The position of the needle above the leather segment (2) is sensed by an optical sensor fixed on the machine and sends signal to the stepper motor (17) for indexing. The stitching will be completed after 65 stitches are made on the circumference of the leather segment (2). As soon as the required counts of the stitches on the periphery is reached, stepper motor (17) stops automatically. The indexer assembly (12) is released from the lock and pushed away so that the stitched leather segment (2) can be removed from the machine.

The following example is given by way of illustration of the present. Invention and should not be construed to limit the scope of the present invention.

EXAMPLE-1

The machine of the present invention with two needles and loopers was used to produce two parallel decorative stitches at the same time on a hemispherical leather segment using wax coated cotton thread of 20 kg breaking strength. These leather segments were supplied by one of the industries and are actually used for producing the cricket balls as per international/national standards.

The specifications of the decorative stitches produced by the machine of the present invention were as follows:

| | |
|---|---|
| Total number of stitches in a single row over the circumference: | 65 |
| Distance between two rows of decorative stitches: | 3 mm |
| Diameter of the needle: | 2 mm |
| Diameter of the thread: | 1 mm |

-continued

| | |
|---|---|
| Thickness of the leather: | 3.5-4 mm |
| Diameter of the hemispherical leather segment: | 72 mm |

The function of the machine was satisfactory.

The function of the machine was satisfactory.

ADVANTAGES OF THE PRESENT INVENTION

The main advantages of the novel machine of the present inventions are:

1. It takes about one hour to complete decorative stitching (two rows) on one hemispherical leather segment by the manual process whereas it takes about 5 minutes for the same operation by the machine of the present invention.
2. The quality of stitching is in conformity with the International Standards laid down.
3. The quality of stitching does not depend on the skill of the operator.
4. The cost of machine stitching is much lower than that of the manual stitching.
5. There is an increase in productivity.
6. There is a decrease in the balls getting rejected.

The invention claimed is:

1. A novel sewing machine for decoratively stitching a cricket ball, said sewing machine comprising:

a dual needle looper assembly comprising of plurality of needles [(5*a*) and (5*b*)] placed parallel to each other in an offset manner and being fixed onto a needle holder (5), said plurality of needles having corresponding loopers [(4*a*) and (4*b*)] placed below the needles, said loopers being mounted on looper holders [(4*c*) and (4*d*)];

said dual needle looper assembly being mounted on a reciprocating means;

said dual needle looper assembly being encased within a hemispherical hollow mandrel assembly (1) having an opening/pores to allow reciprocating movement of the needles;

said hemispherical hollow mandrel assembly being mounted with a hemispherical leather cup (2) on which decorative stitching is to be performed;

said hemispherical hollow mandrel mounted with the leather cup being freely mounted on a ball bearing support (3) and being in contact with a ball holder (13), and said ball holder is mounted on an indexer assembly to provide circular indexing movement to the hemispherical leather cup.

2. A device as claimed in claim 1, wherein the needles (5*a*) and (5*b*) are placed at a parallel distance as desired by the user or as prescribed by the international standards.

3. A device as claimed in claim 2, wherein the needles (5*a*) and (5*b*) are placed at a parallel distance of the order of 3 mm from each other.

4. A device as claimed in claim 1, wherein the needles (5*a*) and (5*b*) are offset circumferentially by a distance of the order of 4.6 mm from each other.

5. A device as claimed in claim 1, wherein loopers (4*a*) and (4*b*) mounted on looper holders (4*c*) and (4*d*) make coordinated oscillating movement with respect to reciprocating movement of the corresponding needles.

6. A device as claimed in claim 1, wherein said reciprocating means comprises of:

a gear box (6) capable of providing reciprocating motion to the plurality of needles and corresponding oscillating motion to respective loopers, said gear box comprising a pair of timer pulleys (7) capable of varying the speed of stitching;

said timer pulley (7) being configured to receive rotational motion from a V-belt pulley (10) through a Timer belt (8), and said V-belt pulley (10) configured to receive rotational motional from a clutch motor (9) through a V-belt (11).

7. A device as claimed in claim 1, wherein the needles are supplied with stitching threads (5*c*) from a plurality of bobbins (5*d* and 5*e*).

8. A device as claimed in claim 1, wherein the opening/pores in the hemispherical hollow mandrel assembly (1) is located on top of the needles such that the needles reciprocate through the opening/pores.

9. A device as claimed in claim 1, wherein the hemispherical hollow mandrel assembly is mounted with the hemispherical leather cup (2) such that the needles are perpendicular to the surface of the hemispherical leather cup.

10. A device as claimed in claim 1, wherein the ball holder (13) is in the form of a hemispherical cup.

11. A device as claimed in claim 1, wherein additional means for clamping the leather cup is optionally provided.

12. A device as claimed in claim 1, wherein the indexing movement to the leather cup is provided in coordination with the reciprocating needle movement.

13. A device as claimed in claim 1, wherein the indexer assembly comprises of a stepper motor (17) being coupled to a worm wheel (20) through a worm shaft (19);

said worm shaft being coupled to the ball holder (13) for providing indexing movement to the leather cup;

a pinion handle (15) mounted on the indexer assembly for moving the indexer assembly (12) towards the hemispherical mandrel (1) and a locking handle (16) mounted on the indexer assembly for locking the position of the indexer assembly with respect to the hemispherical mandrel, and an encoder (14) configured to control the motion of the stepper motor with respect to the reciprocating movement of the needles.

14. A device as claimed in claim 13, wherein the indexer assembly further comprises a top cover (21), an indexer housing (22) and a front end cover (24) for housing the indexer and an encoder housing (23) mounted at a rear end of the indexer assembly for housing the encoder.

15. A device as claimed in claim 1, wherein the dual needle looper assembly is mounted with an optical sensor (25) for sensing the location of the needles with respect to the leather cup and counting the number of stitches made on the leather cup.

16. A device as claimed in claim 15, wherein the output of the optical sensor (25) is provided as an input to the encoder.

17. A device as claimed in claim 16, wherein the output of the encoder controls the circular indexing movement of the hemispherical hollow mandrel.

18. A device as claimed in claim 17, wherein the encoder is an adjustable/programmable encoder so as to obtain uniform spacing between two adjacent stitches.

19. A device as claimed in claim 17, wherein the output of the encoder is preset to provide accurate circular indexing movement to the hemispherical hollow mandrel that are in coordination with the reciprocating movements of the needles.

20. A device as claimed in claim 17, wherein the encoder is adjusted to make 65 stitches in a single row over the circumference.

21. A device as claimed in claim 1, wherein the device takes 5 to 10 minutes to complete two rows of decorative stitching on a hemispherical leather cup.

* * * * *